US009470457B2

(12) United States Patent
Schroeder et al.

(10) Patent No.: US 9,470,457 B2
(45) Date of Patent: Oct. 18, 2016

(54) MELT FURNACE, MELT FURNACE CONTROL SYSTEMS, AND METHOD OF CONTROLLING A MELT FURNACE

(71) Applicant: Honda Motor Co., Ltd., Minato-ku, Tokyo (JP)

(72) Inventors: Karl Schroeder, Columbus Grove, OH (US); Charles W. Drake, Jr., Huntsville, OH (US); Michael E. Devine, II, Russells Point, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 216 days.

(21) Appl. No.: 14/231,078

(22) Filed: Mar. 31, 2014

(65) Prior Publication Data

US 2015/0276317 A1 Oct. 1, 2015

(51) Int. Cl.

| | |
|---|---|
| ***F27D 3/14*** | (2006.01) |
| ***F27D 19/00*** | (2006.01) |
| ***F27D 21/00*** | (2006.01) |
| ***F27D 99/00*** | (2010.01) |
| ***F27B 19/04*** | (2006.01) |

(52) U.S. Cl.

CPC ..... *F27D 19/00* (2013.01); *F27B 19/04* (2013.01); *F27D 21/0014* (2013.01); *F27D 21/0028* (2013.01); *F27D 99/0033* (2013.01); *F27D 3/14* (2013.01); *F27D 2019/0003* (2013.01)

(58) Field of Classification Search

CPC ..... F27D 19/00; F27D 3/14; F27D 21/0014
USPC ..... 266/99, 44, 78
See application file for complete search history.

(56) References Cited

U.S. PATENT DOCUMENTS

| | | | | |
|---|---|---|---|---|
| 3,078,669 | A | 2/1963 | Williams | |
| 4,255,133 | A | 3/1981 | Tanifuji et al. | |
| 4,473,103 | A | 9/1984 | Kenney et al. | |
| 4,486,228 | A | 12/1984 | Ormesher | |
| 4,491,474 | A | 1/1985 | Ormesher | |
| 4,518,424 | A | 5/1985 | Ormesher | |
| 4,655,436 | A | 4/1987 | Williams | |
| 4,754,801 | A * | 7/1988 | Ueno | B22D 17/00 164/153 |
| 5,272,719 | A | 12/1993 | Cartlidge et al. | |
| 5,364,080 | A | 11/1994 | Kraemer et al. | |
| 5,392,312 | A | 2/1995 | Bernet et al. | |
| 5,407,000 | A | 4/1995 | Mercer, II et al. | |
| 5,643,528 | A | 7/1997 | Le Gras | |
| 5,666,377 | A | 9/1997 | Havas et al. | |
| 6,148,019 | A | 11/2000 | Fishman et al. | |
| 6,163,019 | A | 12/2000 | Green et al. | |
| 6,379,609 | B1 | 4/2002 | Stummer | |
| 6,585,797 | B2 | 7/2003 | Kinosz et al. | |

(Continued)

*Primary Examiner* — Scott Kastler
(74) *Attorney, Agent, or Firm* — Arent Fox LLP

(57) ABSTRACT

A melt furnace including a first reservoir, a second reservoir, a holding reservoir, and a control system including a controller is provided. The first reservoir and the second reservoir are in fluid communication with the holding reservoir to flow molten materials to the holding reservoir. The controller is in communication with a first material level sensor, a second material level sensor, a holding reservoir temperature sensor, and a molten material level sensor assembly. The controller is adapted to adjust an output level of at least one of the first reservoir melt burner and the second reservoir melt burner based, at least in part, on one or more received signals to control the flow of molten materials from the first reservoir and the second reservoir to maintain a level of molten material in the holding reservoir.

19 Claims, 7 Drawing Sheets

(56) References Cited

U.S. PATENT DOCUMENTS

| | | | | |
|---|---|---|---|---|
| 6,637,496 | B1 | 10/2003 | Macheske et al. | |
| 6,666,258 | B1 | 12/2003 | Kono | |
| 7,514,033 | B1 | 4/2009 | Schroeder et al. | |
| 2001/0028136 | A1 | 10/2001 | Hertwich | |
| 2013/0068412 | A1* | 3/2013 | Tipton | B22D 17/02 164/133 |
| 2013/0307202 | A1 | 11/2013 | Hegenberg et al. | |
| 2015/0276317 | A1* | 10/2015 | Schroeder | F27D 19/00 266/44 |

* cited by examiner

MELT FURNACE, MELT FURNACE CONTROL SYSTEMS, AND METHOD OF CONTROLLING A MELT FURNACE

BACKGROUND

The subject matter disclosed herein relates to a melt furnace and a melt furnace control system and, more particularly, to a melt furnace burner output control system and methods of controlling burners in a melt furnace.

Melt furnaces and control systems for melt furnaces for providing molten material for die casting metal components are well known in the art. Many large-scale operations rely on multiple furnaces to provide enough molten material to maintain a constant production pace. Configuration and physical layout of melt furnaces represent significant capital expenditures for die cast manufacturing operations.

All die cast manufacturing operations produce scrap and require an almost constant supply of molten metal. Scrap material from the production process can build up and present an issue for a manufacturing facility if not dealt with efficiently. One common solution is to feed the scrap material back into the melt furnace to be consumed again along with new raw stock. Maintaining a constant supply of molten metal can be energy intensive and requires active management of the material going into a melt furnace.

A melt furnace and a melt furnace control system configured to maximize consumption of scrap materials from a production process, while minimizing energy consumption of the melting process and maintaining a constant flow of molten material to the production process is desirable.

SUMMARY

According to one aspect, a melt furnace includes a first reservoir including a first material level sensor and at least one first reservoir melt burner, a second reservoir including a second material level sensor and at least one second reservoir melt burner, and a holding reservoir including at least one holding reservoir burner, a temperature sensor, and a molten material level sensor assembly. The first reservoir and the second reservoir are in fluid communication with the holding reservoir to flow molten materials to the holding reservoir. A control system includes a controller in signal communication with the first material level sensor, the second material level sensor, the holding reservoir temperature sensor, and the molten material level sensor assembly. The controller is adapted to adjust an output level of at least one of the at the least one first reservoir melt burner and the at least one second reservoir melt burner to one of a plurality of levels based, at least in part, on one or more signals received from at least one of the first material level sensor, the second material level sensor, the holding reservoir temperature sensor, and the molten material level sensor assembly, to control the flow of molten materials from at least one of the first reservoir and the second reservoir to maintain a level of molten material in the holding reservoir.

According to another aspect, a control system for a melt furnace is provided. The melt furnace includes a first reservoir having a first material level sensor and a first reservoir burner, a second reservoir having a second material level sensor and a second reservoir burner, and a holding reservoir having a molten material level sensor assembly, a temperature sensor, and a holding reservoir burner. The holding reservoir is in fluid communication with each of the first reservoir and the second reservoir to receive a first flow of molten material from the first reservoir and a second flow of molten material from the second reservoir. The control system includes a controller in signal communication with each of the first material level sensor, the second material level sensor, the holding reservoir temperature sensor, and the holding reservoir material level sensor assembly. The controller is configured to maintain a level of molten material in the holding reservoir by adjusting at least one of a first output level of the first reservoir burner and a second output level of the second reservoir burner based, at least in part, on one or more signals received from one or more of the first material level sensor, the second material level sensor, the holding reservoir temperature sensor, and the molten material level sensor assembly, to control the first flow of molten material and the second flow of molten material.

According to a further aspect, a method for controlling a melt furnace is provided. The melt furnace includes a first reservoir having a first material level sensor and a first reservoir melt burner, a second reservoir having a second material level sensor and a second reservoir melt burner, and a holding reservoir having a molten material level sensor assembly, a temperature sensor, and a holding reservoir burner. The holding reservoir is in fluid communication with each of the first reservoir and the second reservoir to receive a first flow of molten material from the first reservoir and a second flow of molten material from the second reservoir. The method includes receiving by a controller one or more signals from one or more of the first material level sensor, the second material level sensor, and the molten material level sensor assembly. At least one of a first output level of the first reservoir burner and a second output level of the second reservoir burner is adjusted with the controller to one of a plurality of output levels between and including a high output level and a low output level. A level of molten material in the holding reservoir is maintained with the controller by controlling at least one of a first molten material flow from the first reservoir into the holding reservoir and a second molten material flow from the second reservoir into the holding reservoir based, at least in part, on the one or more signals.

BRIEF DESCRIPTION OF THE DRAWINGS

Other aspects and advantages of certain embodiments will become apparent upon consideration of the following detailed description, wherein similar structures have similar reference numerals.

DETAILED DESCRIPTION

Figure 1:
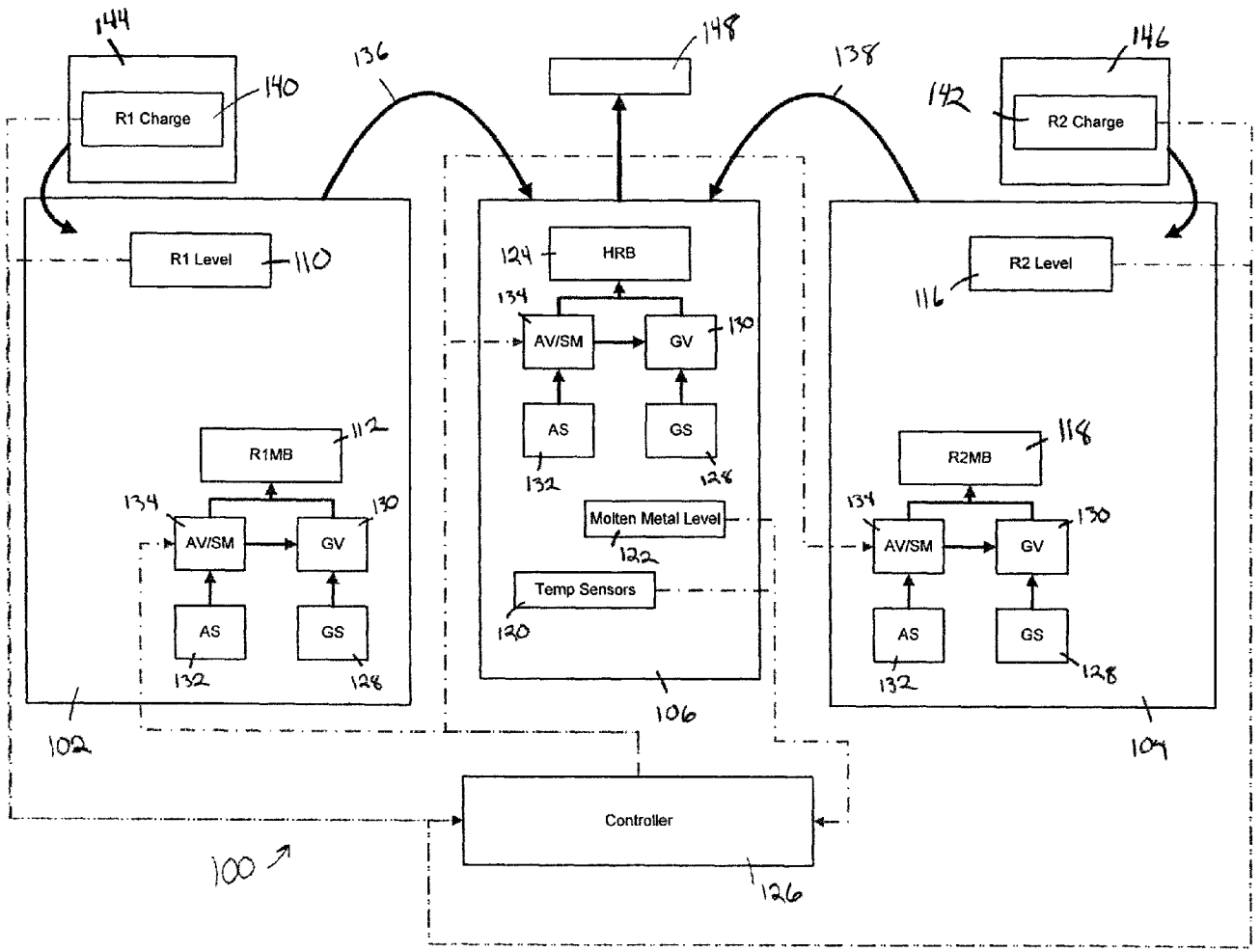
FIG. 1 is a schematic representation of an exemplary melt furnace.
Figure 2:
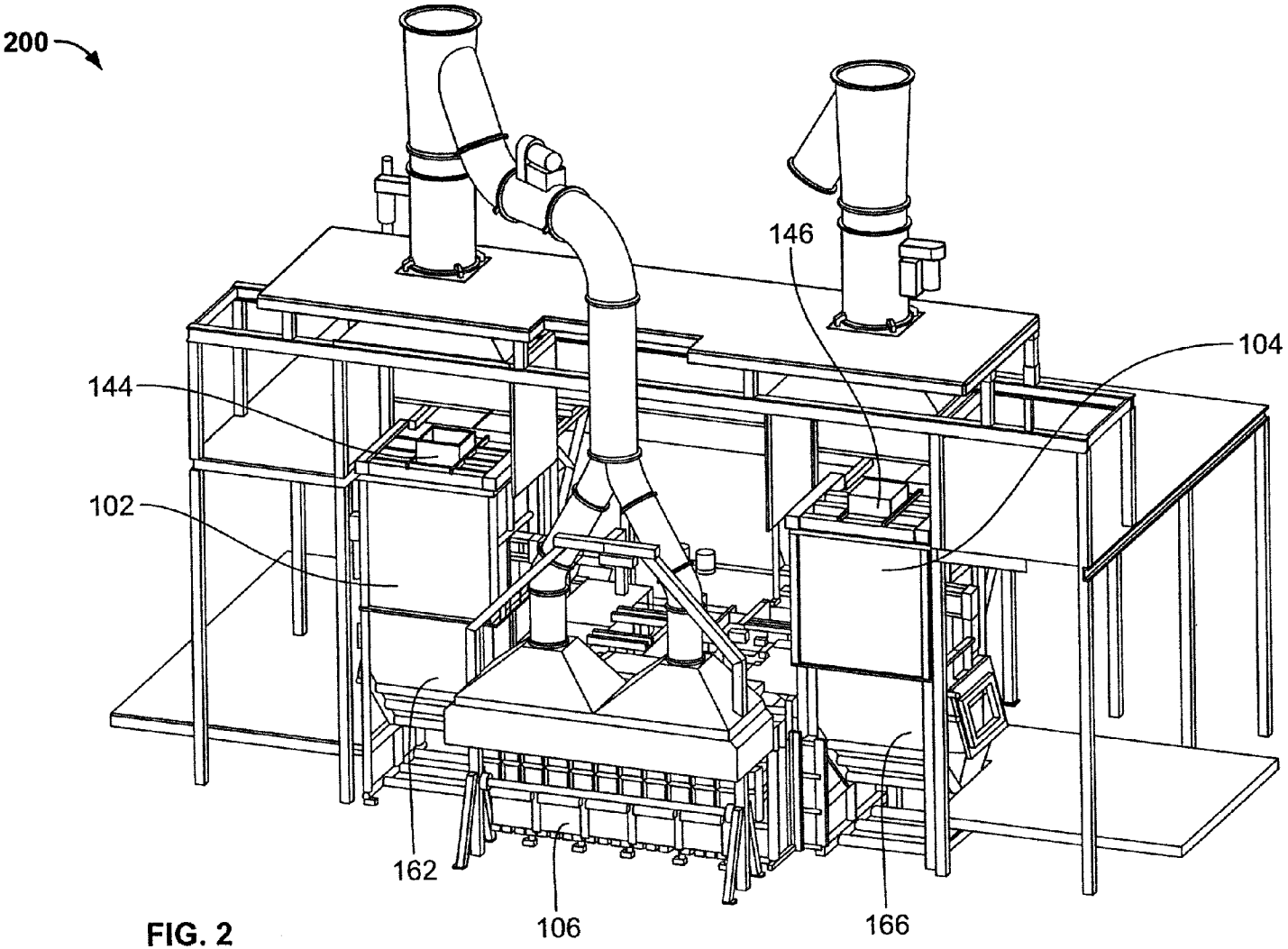
FIG. 2 is a perspective view of the melt furnace shown in FIG. 1.

Referring initially to FIG. 1, a schematic representation of an exemplary melt furnace 100 is depicted. The melt furnace 100 includes a first reservoir 102, a second reservoir 104, and a holding reservoir 106 in fluid communication with each of the first reservoir 102 and the second reservoir 104.

Generally, the melt furnace 100 may be used for melting metals and the like for casting operations known to one having ordinary skill in the art. The first reservoir 102 and the second reservoir 104 are configured to receive materials (i.e., ingot and/or scrap) to be melted. The first reservoir 102 includes a first material level indicator or sensor 110 and at least one first reservoir melt burner 112. The second reservoir includes a second material level indicator or sensor 116 and at least one second reservoir melt burner 118. The holding reservoir 106 includes a temperature sensor 120, a molten metal level assembly 122, and at least one holding reservoir burner 124. The melt furnace 100 also includes a controller 126 in operational control and/or signal communication with each of the first material level sensor 110, the second material level sensor 116, the holding reservoir temperature sensor 120, and the molten metal level assembly 122. The controller 126 is configured to transmit one or more signals to and/or receive one or more signals from at least one of the first material level sensor 110, the second material level sensor 116, the holding reservoir temperature sensor 120, and the molten metal level assembly 122.

Still referring to FIG. 1, the melt furnace 100 melts materials in the first reservoir 102 utilizing the first reservoir melt burner 112 and materials in the second reservoir 104 utilizing the second reservoir melt burner 118, which, in this embodiment, are gas-burning burners. The temperature of the molten materials contained within the holding reservoir 106 is controlled with the holding reservoir burner 124, also a gas-burning burner in this embodiment. Although described herein as gas burning burners 112, 118, 124 may be any suitable type of heating element including, for example, but not limited to, induction heating elements.

In one embodiment, all of the burners are gas-burning devices that operate in a similar fashion. Each of the first reservoir melt burner 112, the second reservoir melt burner 118, and the holding reservoir burner 124 are connected to a gas supply 128 through an independent gas valve 130 and each is connected to an air supply 132 through a servo motor controlled air valve 134. In one embodiment, the gas valves 130 are diaphragm valves and the air vales 134 are butterfly valves or any suitable valve that is known to one having skill in the art. The controller 126 is in communication with the servo motors of the servo motor controlled air valves 134. The amount of air that flows through the air valve 134 is directly related to the position of the servo motor and controllable by the controller 126. Air flows from each air valve 134 to the respective burners 112, 118, 124. Air also flows from each air valve 134 to the associated gas valve 130. The amount of gas that flows from each of the gas valves 130 to the respective burners 112, 118, 124 is proportional to the amount of air flowing from the air valves 134. Thus, the controller 126 is configured to control the burners 112, 118, 124 each of which includes an output level depending on the amount of air and gas flowing to it respectively. Each burner 112, 118, 124 may be at a low level burner or a high level burner. In one embodiment, the controller 126 is also capable of positioning the air valves 134 in a plurality of positions between a minimum air flow position corresponding to a low output level for the associated burner and a maximum air flow position corresponding to a high output level for the associated burner. The minimum output level for the first reservoir melt burner 112 and the second reservoir melt burner 118 corresponds to a temperature that is below the melting point of the materials in the respective reservoirs. The maximum output level for the first reservoir melt burner 112 and the second reservoir melt burner 118 corresponds to a temperature that is above the melting point of the materials in the respective reservoirs. All of the burners 112, 118, 124 are at peak gas burning efficiency when at a maximum output level and consume a minimum amount of gas when at a minimum output level.

In one embodiment, the holding reservoir burner 124 is the same or similar to the melt burners 112, 118. In this embodiment, the controller 126 closes the air valve 134 to prevent air from being supplied to the holding reservoir burner 118 allowing the output level of the holding reservoir burner 118 to be at a temperature below the melting point of the materials within the holding reservoir 124. Alternatively, the minimum output level of the holding reservoir burner 124 corresponds to a temperature above the melting temperature of the molten materials within the holding reservoir 124. It is further contemplated that all of the burners 112, 118, 124 in the furnace 100 may be set to an output level by the controller 126 independently of each other. Further still, the low output level of the melt burners 112, 118 is sufficient to maintain the temperature of the materials stored in the first reservoir 102 and the second reservoir 104, respectively, near but below the melting temperature of the materials. Thus, the controller 126 is capable of controlling a first flow of molten material 136 from the first reservoir 102 into the holding reservoir 106 and a second flow of molten material 138 from the second reservoir 104 into the holding reservoir 106 independently to maintain a desired or selected level of molten material in the holding reservoir 106. As the controller 126 increases the output level of the melt burners 112, 118 the volume of the first flow of molten material 136 and the volume of the second flow of molten material 138 increases to a maximum volume at the high output level of the melt burners 112, 118. The controller 126 may be capable of correlating the volume of the first flow of molten material 136 and the volume of the second flow of molten material 138 to the output levels of the respective melt burners 112, 118 in certain embodiments.

In one embodiment, the controller 126 is also in operational control and/or signal communication with a first reservoir charge indicator or sensor 140 and a second reservoir charge indicator or sensor 142. The reservoir charge sensors 140, 142 detect the level/amount of material in the charge areas 144, 146 respectively. For example, the first reservoir charge sensor 140 detects when a first charge area 144 is full and ready to transfer materials to the first reservoir 102 and the second reservoir charge sensor 142 detects when the second charge area 146 is full and ready to transfer materials to the second reservoir 104. In one embodiment, the first reservoir 102 receives ingot material from the first charge area 144 after first reservoir charge sensor 140 indicates a full charge and the second reservoir 104 receives scrap material from the second charge area 146 after the second reservoir charge sensor 142 indicates a full charge. In this embodiment, the controller 126 actively manages the amount and/or type of materials melted by the furnace 100 and maintains the molten material level in the holding reservoir 106 at a desired or selected level based, at least partially, on one or more signals received from one or more of the first reservoir charge sensor 140, the first reservoir material level sensor 110, the second reservoir charge sensor 142, and the second reservoir material level sensor 116. The materials within the first charge area 144 and the second charge area 146 may be manually or automatically loaded into the respective reservoirs 102, 104 in response to signals from the charge sensors 140, 142. The controller 126 will only allow the transfer of materials to the respective reservoirs 102, 104 when the first material level sensor 110 or the second material level sensor 116 indicates that space is available with the respective reservoir 102, 104. The molten material in the holding reservoir 106 may be drawn out or flow to a dispensing area 148 to be consumed by the production process.

Figure 3:
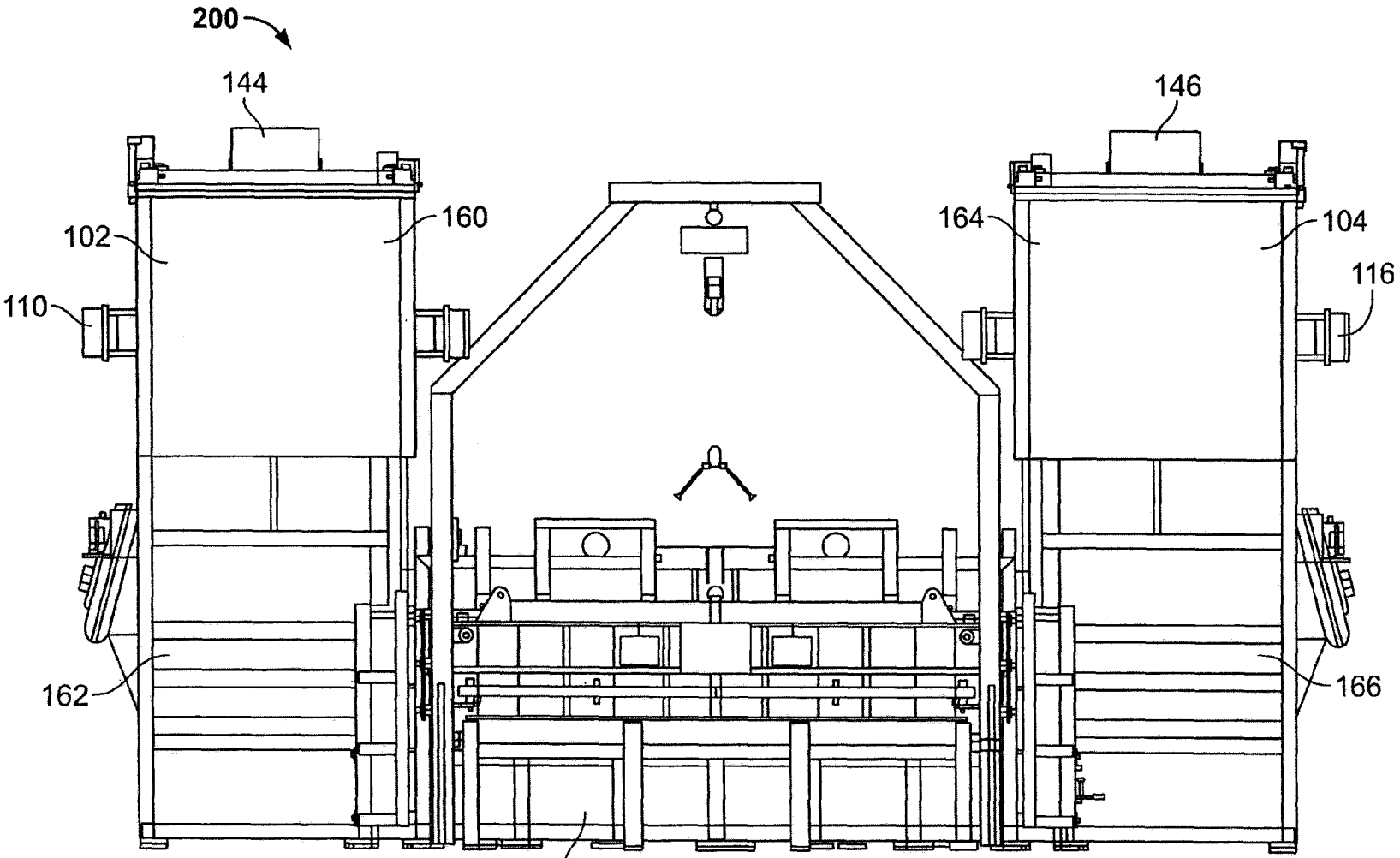
FIG. 3 is a front view of the melt furnace of FIG. 2.
Figure 4:
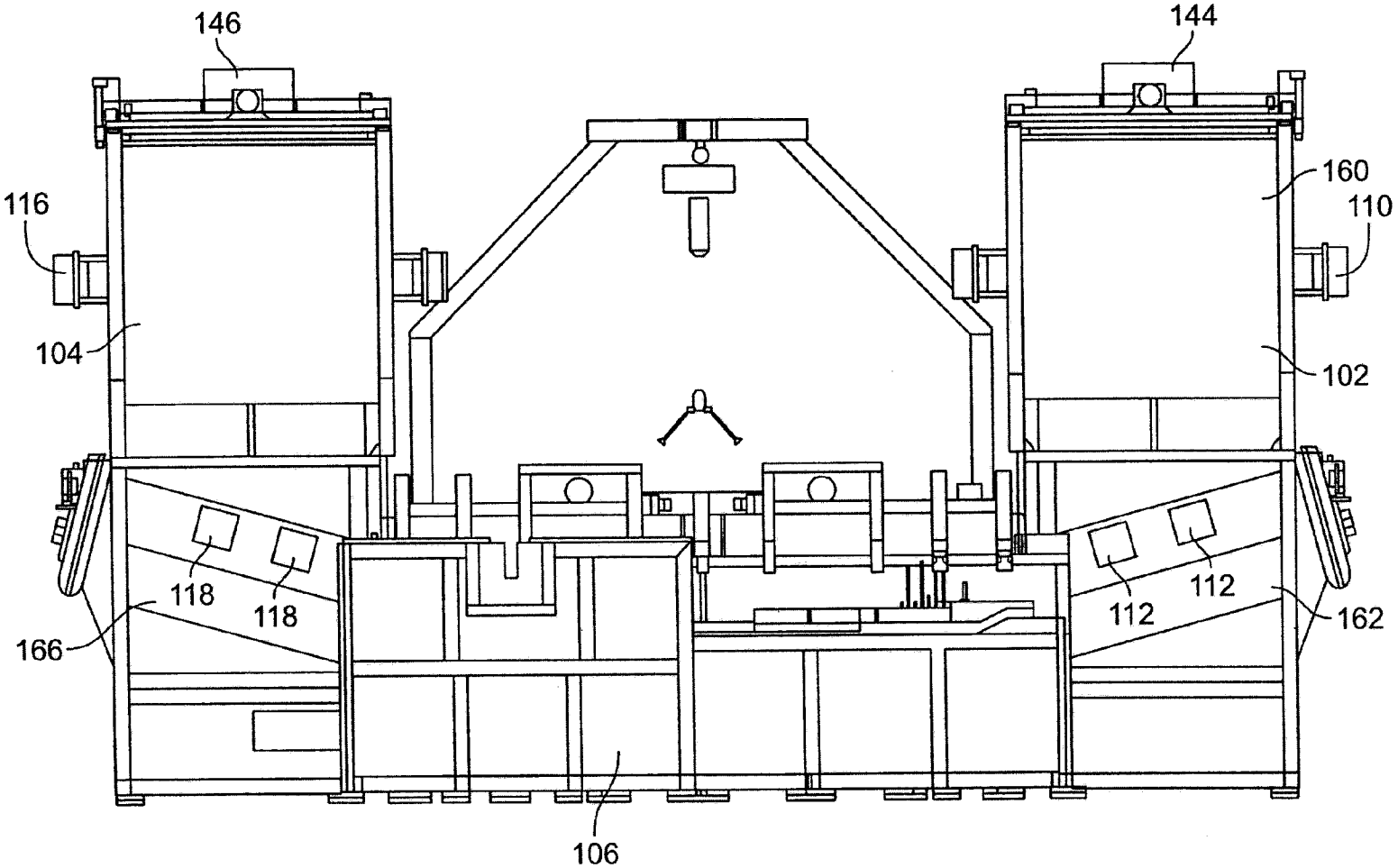
FIG. 4 is a rear view of the melt furnace of FIG. 2.
Figure 5:
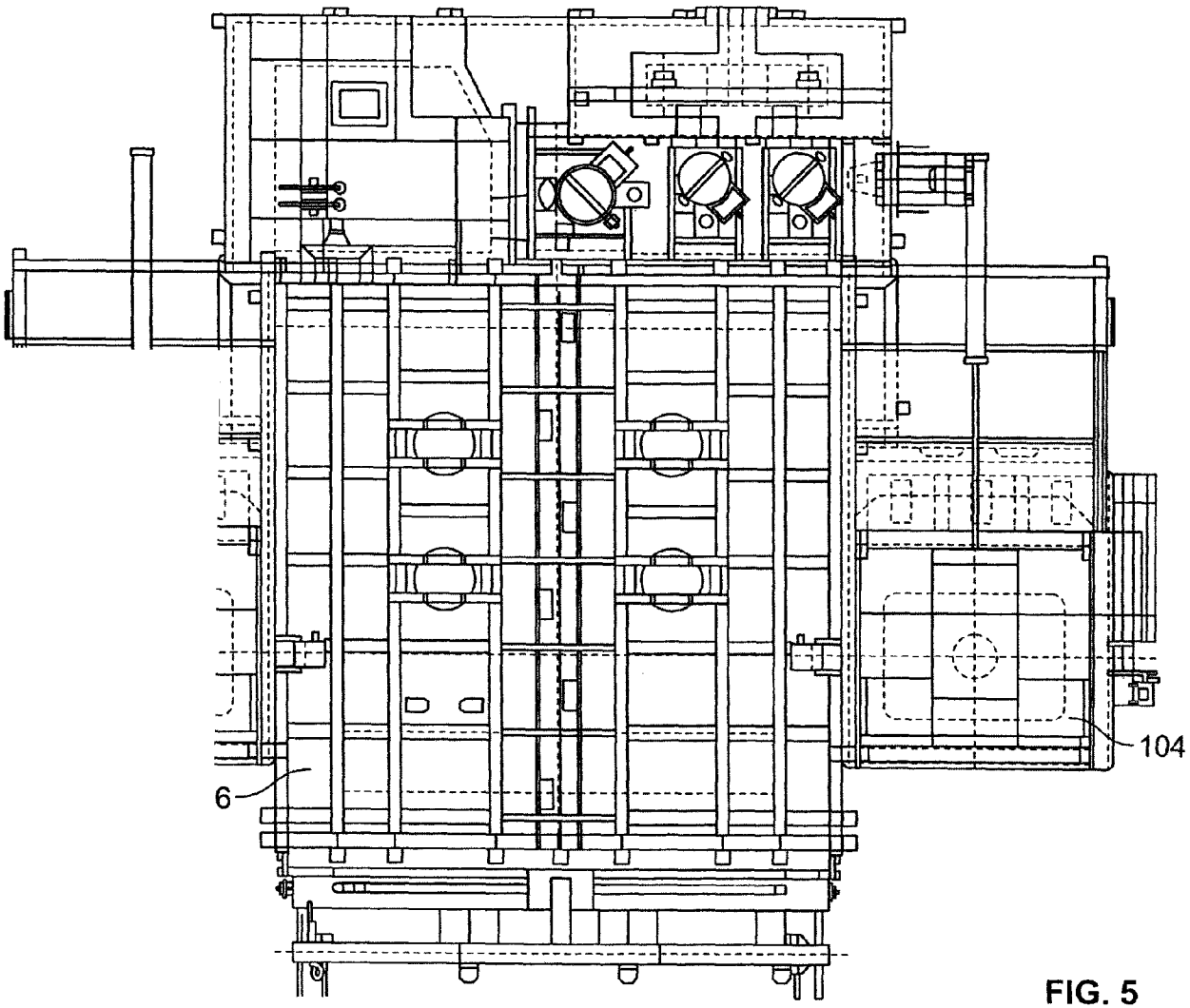
FIG. 5 is a top view of the melt furnace of FIG.2.

Referring now to FIGS. 2-5, an exemplary embodiment of a melt furnace 200 is depicted. In one embodiment, the melt furnace 200 includes all of the features and characteristics of the melt furnace 100 and like elements are numbered the same. The first reservoir 102 and the second reservoir 104 are generally tower-like structures, but not specifically limited to this style. In some embodiments, materials are charged directly into a melt bath, known in the industry as "reverberatory style". It is contemplated that one having skill in the art would understand the teachings of the present disclosure to apply them to many known configurations of melt furnaces. The first reservoir 102 includes an upper end 160 and a lower end 162 and the second reservoir 104 includes an upper end 164 and a lower end 166 as shown in FIG. 3, for example. Materials to be melted are fed into the first reservoir 102 from the first charge area 144. Similarly, materials to be melted are fed into the second reservoir 104 from the second charge area 146. The lower ends 162, 166 of the first reservoir 102 and the second reservoir 104 are configured to prevent the solid materials (ingot or scrap) from entering the holding reservoir 106 until the materials are melted. The first charge area 144 is positioned at or near the top of the first reservoir 102 and the second charge area 146 is positioned at or near the top of the second reservoir 104. It is contemplated that transfer of materials from the first charge area 144 into the first reservoir 102 and from the second charge area 146 to the second reservoir 104 may be accomplished by means known to those having skill in the art. Further, the first material level sensor 110, the second material level sensor 116, the first charge sensor 140, and the second charge sensor 142 may be of any suitable type known to those having skill in the art. It is also contemplated that each of the reservoirs 102, 104, 106 may include any suitable number of burners corresponding to the size and the capacity of the melt furnace 200.

Figure 6:
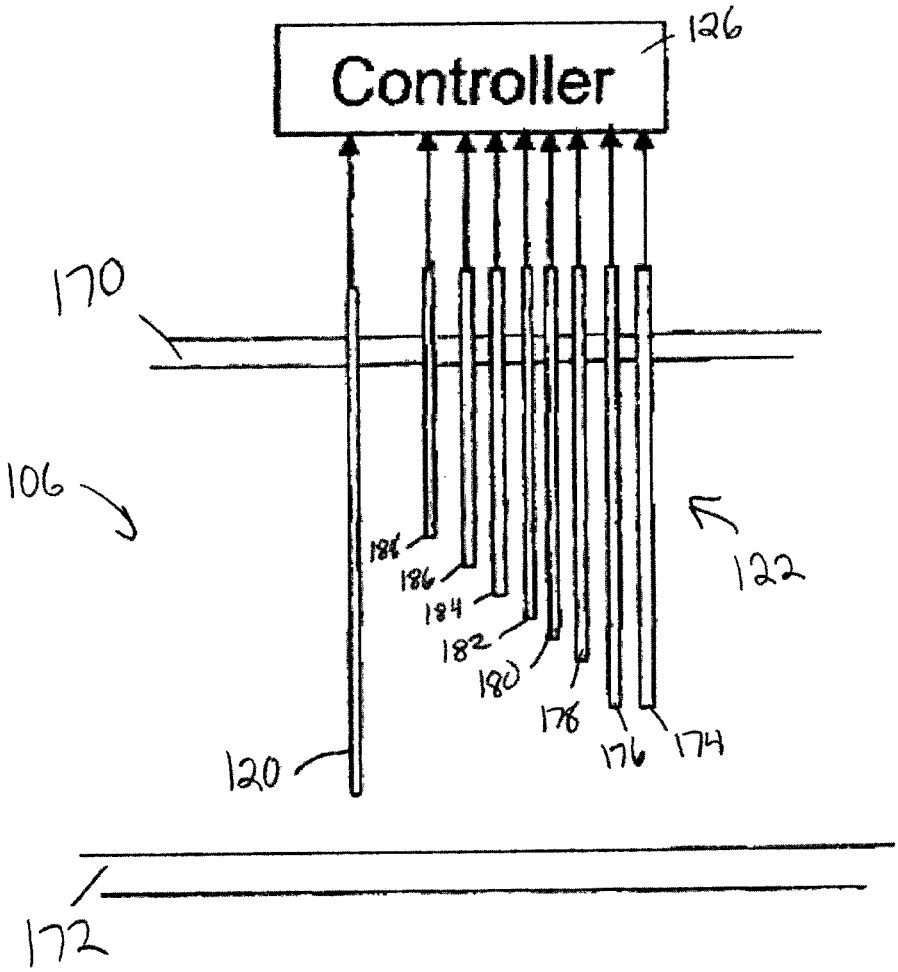
FIG. 6 is a schematic representation of an exemplary embodiment of a molten metal level sensor assembly that may be included in the melt furnace shown in FIG. 1.

Referring now to FIG. 6, a schematic view of the molten material level sensor assembly 122 and the temperature sensor 120 is depicted. In one embodiment, the temperature sensor 120 is a thermal couple extending through an upper portion 170 of the holding reservoir 106. The thermal couple temperature sensor 120 extends into the holding reservoir a suitable distance such that it is in constant contact with the molten materials within the holding reservoir 106 without extending through a lower portion 172 of the holding reservoir 106. In this embodiment, the molten material level sensor assembly 122 includes a series of conducting rods each extending into the molten material and in signal communication with the controller 126. For example, a first rod 174 and a second rod 176 extend down through the upper portion 170 of the holding reservoir 106. The first rod 174 is connected to electrical ground. The second rod 176 (and all subsequent rods to be described) are biased with a voltage through the controller 126. Thus, when molten metal touches the first rod 174 and the second rod 176, the controller 126 detects a current flow. The additional rods 178, 180, 182, 184, 186, 188 are all of shorter lengths than the first rod 174 and the second rod 176. Thus, the controller 126 is able to determine the level of the molten material by which rods have a current flowing therethrough. The final or shortest rod 188 acts as an upper limit to the molten material level and, in a particular embodiment, acts as an overflow fail safe. The second rod 176 detects the lower limit and, in a particular embodiment, detects a work stoppage situation. The total number of rods can vary depending on the level of control desired or required. The normal operating molten material level in the holding reservoir 106 is between the rod 186 and the rod 178. The rod 186 is slightly longer than the final rod 188 and the rod 178 is not as long as the second rod 176. Thus, by monitoring the currents flowing through the rods 186, 184, 182, 180, and 178 the controller 126 can detect the level of molten material within the holding reservoir 106

Figure 7:
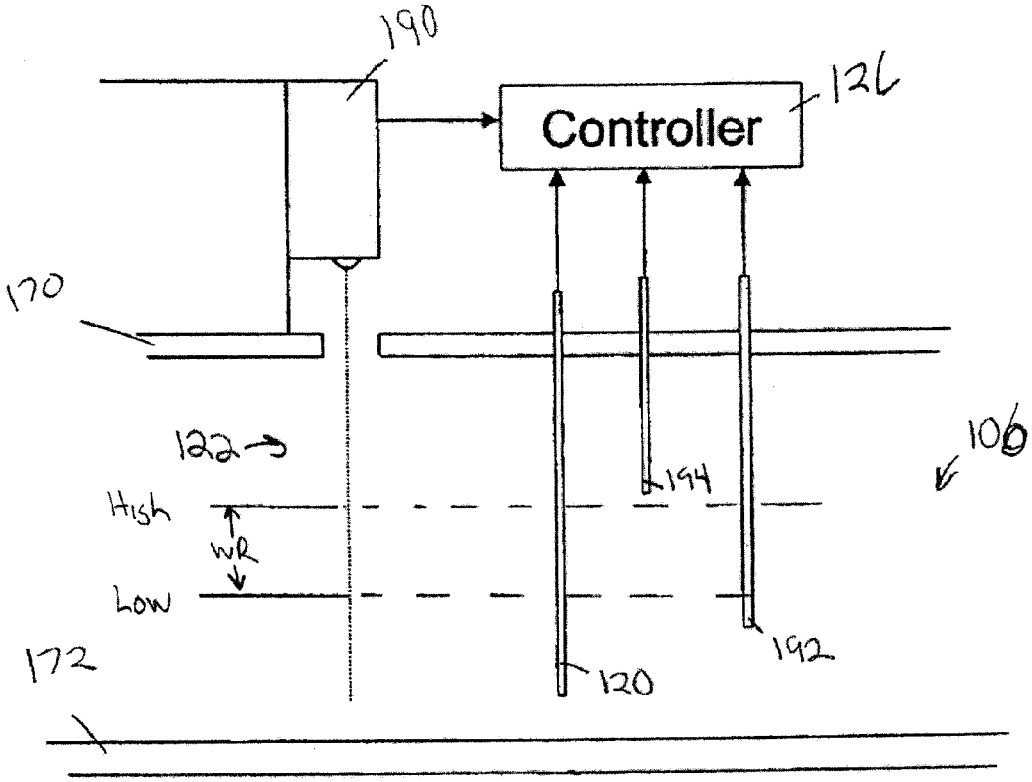
FIG. 7 is schematic representation of another embodiment of a molten metal level sensor assembly that may be included in the melt furnace shown in FIG. 1.

Referring now to FIG. 7, an alternate embodiment of the molten material level sensor assembly 122 is depicted. In this embodiment, one or more of the rods 174, 176, 178, 180, 182, 184, 186, and 188 shown in FIG. 6 are replaced with a continuously variable feedback sensor system 190 (e.g., lasers, pressure, radar, sonic). The continuously variable feedback sensor system 190 provides instantaneous feedback to the controller 126 on the height of the molten material in the holding reservoir. The embodiment depicted in FIG. 7 includes a thermocouple temperature sensor 120, a ground rod 192, and an upper limit rod 194. Thus, the working range, WR, is between a high level that is just below the bottom of the upper limit rod 194 and a low level above the terminal end of the ground 192. In this embodiment, the upper limit rod only acts as a failsafe to prevent the overfilling of the holding reservoir 106. One advantage of this embodiment is the constant feedback provided by the continuously variable feedback sensor system 190 allows the controller 126 to detect the rate of change in the level of molten material in the holding reservoir. This allows the controller 126 to more precisely control the flow of molten material from the first and second reservoirs 102, 104 while maintaining the level of molten material within the holding reservoir 106.

Now referring to FIGS. 1-7, in one embodiment, the melt furnace 100 operates as follows. Scrap material from production may be melted in the second reservoir 104 and ingot material may be melted in the first reservoir 102. The first material level sensor 110 and the second material level sensor 116 prevent the respective reservoir from being overfilled and transmit one or more signals to the controller 126 when space is available in the respective reservoirs. During production operations, the controller 126 controls the output level of the first reservoir melt burner 112 and the output level of the second reservoir melt burner 118 to be at a high level so that the first flow of molten material 136 and the second flow of molten material 138 are at a maximum. Using the feedback provided from the molten material level sensor assembly 122 in the holding reservoir 106, the controller 126 may reduce the output level for the first reservoir melt burner 112 and/or the second reservoir melt burner 118 depending on the availability of materials as the level of molten materials increases. For example, if there is sufficient scrap material in the second reservoir charging area 146, the controller may reduce the output level of the first reservoir melt burner 112 to a level below the maximum output level to reduce the first flow of molten material 136. At the same time, the controller 126 may increase the output level of the second reservoir melt burner 118 to a high level. Thus, the second flow of molten material 138 (for example, melted scrap from production) is maximized and the scrap materials accumulating in the second reservoir charge area 146 may be added to the second reservoir 104 when volume within the second reservoir 104 is available. This operational configuration will prevent the build up of scrap in the manufacturing process.

Alternatively, the above-described configuration is reversed when there is a shortage of scrap materials in the second reservoir 104 or the second reservoir charging area 146. If the situation occurs that either the first reservoir 102 or the second reservoir 104 runs out of charging materials, the respective burner output level is lowered by the controller 126 to a low level to limit or prevent the flow of molten material for the respective reservoir into the holding reservoir 106.

In another alternative embodiment, in an operational configuration in which there is a varying supply of scrap material and a constant supply of ingot, the servo motor controlled air valves 134 of the respective melt burners 112, 118 allow for the output of the respective melt burners 112, 118 to be at one of a plurality of levels between a high level and a low level. Thus, the controller 126 is configured to set the second reservoir melt burner 118 output level at a level between the high level and the low level such that the melting of the scrap in the second reservoir 104 is proportional to the amount of scrap being produced by the production process. In this operational configuration, the output levels of the melt burners 112, 118 are adjusted to any one of a plurality of levels between the high level and the low level depending on a ratio of available scrap material to available ingot material. This operational configuration allows for increased flexibility depending on the availability of the materials to be melted.

In all of the operational configurations described above, the controller 126 monitors the molten material level in the holding reservoir 106. The first flow of molten material 136 and the second flow of molten material 138 may be reduced or completely stopped as the level of molten material in the holding reservoir 106 increases. Environmental conditions along with the rate that the production process dispenses molten materials out of the dispensing area 148 may result in the cooling of molten material in the holding reservoir 106. The controller 126 detects the temperature of the molten material in the holding reservoir 106 and adjusts the output level of the holding reservoir burner 124 to one of a plurality of levels between a high output level and a low output level so that the temperature of the molten material in the holding reservoir 106 is always above the melting point.

It is also contemplated that the melt furnace 200 include redundant back-up systems. For example, the controller 126 and all of the sensors (temperature 120, molten metal level sensor assembly 122, material level sensors 110, 116, and charge sensors 140, 142) include primary systems and secondary back-up systems. Thus, in case of a failure of the primary system, the back-up system will continue functioning to prevent an unsafe operating condition.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended the scope be defined by the claims appended hereto. Additionally, the features of various implementing embodiments may be combined to form further embodiments.

What is claimed is:

1. A melt furnace, comprising:

a first reservoir including a first material level sensor, at least one first reservoir melt burner, and a first charge full indicator;

a second reservoir including a second material level sensor, at least one second reservoir melt burner, and a second charge full indicator;

a holding reservoir including at least one holding reservoir burner, a temperature sensor, and a molten material level sensor assembly, wherein the first reservoir and the second reservoir are in fluid communication with the holding reservoir to flow molten materials to the holding reservoir; and a control system including a controller in signal communication with the first material level sensor, the first charge full indicator, the second material level sensor, the second charge full indicator, the holding reservoir temperature sensor, and the molten material level sensor assembly, the controller adapted to adjust an output level of at least one of the at the least one first reservoir melt burner and the at least one second reservoir melt burner to one of a plurality of levels based, at least in part, on one or more signals received from at least one of the first material level sensor, the second material level sensor, the holding reservoir temperature sensor, and the molten material level sensor assembly, to control the flow of molten materials from at least one of the first reservoir and the second reservoir to maintain a level of molten material in the holding reservoir and to prevent the build up of material in at least one of a first charge area of the first reservoir based on the first charge full indicator and a second charge area of the second reservoir based on the second charge full indicator.

2. The melt furnace of claim 1, wherein the first charge area includes the first charge full indicator configured to transmit a signal to the controller indicating that material within the first charge area is ready to be transferred to the first reservoir and the second charge area includes the second charge full indicator configured to transmit a signal to the controller indicating that material within the second charge area is ready to be transferred to the second reservoir.

3. The melt furnace of claim 2, wherein at least one of the first reservoir and the second reservoir is configured to be charged with scrap material from a manufacturing process, and wherein the controller preferentially adjusts the output level of at least one of the at the least one first reservoir melt burner and the at least one second reservoir melt burner to one of a plurality of levels in response to the one or more signals to control the flow of molten materials from at least one of the first melt reservoir and the second melt reservoir to maintain the level of molten material in the holding reservoir.

4. The melt furnace of claim 3, wherein the output level of the at least one first reservoir melt burner, the at least one second reservoir melt burner, and the at least one holding reservoir burner is adjusted to one of the plurality of levels between and including a high output level and a low output level.

5. The melt furnace of claim 4, wherein the first reservoir melt burner includes a first servo motor controlled air valve configured to control an air supply to the first reservoir burner and a first gas valve configured to control a gas supply to the first reservoir burner and the second reservoir melt burner includes a second servo motor controlled air valve configured to control an air supply to the second reservoir burner and a second gas valve configured to control a gas supply to the second reservoir burner, the controller in operational control communication with a first servo motor to control the air valve to provide the air supply to the first reservoir melt burner and a second servo motor to control the air valve to provide the air supply to the second reservoir melt burner to control the output level of the first reservoir melt burner and the output level of the second reservoir melt burner by signaling the servo motor controlled air valves to adjust the air supply to the melt burners.

6. The melt furnace of claim 5, wherein the controller is configured to open the first servo motor controlled air valve to a first output level and the first gas valve opens to a second output level dependent on the first output level, each of the first output level and the second output level corresponding to one of the plurality of output levels of the first reservoir melt burner.

7. The melt furnace of claim 6, wherein the controller is further configured to correlate a first flow of molten material into the holding reservoir to the output level of the first reservoir melt burner and a second flow of molten material into the holding reservoir to the output level of the second reservoir melt burner.

8. A control system for a melt furnace, the melt furnace including a first reservoir having a first material level sensor, a first reservoir burner, and a first charge full indicator, a second reservoir having a second material level sensor, a second reservoir burner, and a second charge full indicator, and a holding reservoir having a molten material level sensor assembly, a temperature sensor, and a holding reservoir burner, wherein the holding reservoir is in fluid communication with each of the first reservoir and the second reservoir to receive a first flow of molten material from the first reservoir and a second flow of molten material from the second reservoir, the control system comprising:

a controller in signal communication with each of the first material level sensor, the first charge full indicator, the second material level sensor, the second charge full indicator, the holding reservoir temperature sensor, and the molten material level sensor assembly, the controller configured to maintain a level of molten material in the holding reservoir by adjusting at least one of a first output level of the first reservoir burner and a second output level of the second reservoir burner based, at least in part, on one or more signals received from one or more of the first material level sensor, the second material level sensor, the holding reservoir temperature sensor, and the molten material level sensor assembly, to control the first flow of molten material and the second flow of molten material and to prevent the build up of material in at least one of a first charge area of the first reservoir based on the first charge full indicator and a second charge area of the second reservoir based on the second charge full indicator.

9. The control system of claim 8, wherein the control system is configured to be in signal communication with the first charge full indicator and the second charge full indicator to receive signals from the first charge full indicator indicating that material within the first charge area is ready for introduction into the first reservoir and the second charge full indicator indicating that material within the second charge area is ready for introduction into the second reservoir.

10. The control system of claim 9, wherein at least one of the first reservoir and the second reservoir is configured to be charged with scrap material from a manufacturing process, and wherein the controller preferentially adjusts at least one of the first output level and the second output level in response to the one or more signals to control at least one of the first flow of molten material and the second flow of molten material.

11. The control system of claim 10, wherein the first output level, the second output level, and a third output level of the holding reservoir burner are each adjusted by the controller to one of a plurality of levels between and including a high output level and a low output level.

12. The control system of claim 11, wherein the first reservoir melt burner includes an air valve configured to control an air supply to the first reservoir burner and a gas valve configured to control a gas supply to the first reservoir burner, the controller in operational control communication with a servo motor to control the air valve to provide the air supply to the first reservoir melt burner.

13. The control system of claim 12, wherein the controller is configured to correlate the level of molten material in the holding reservoir to at least one of the plurality of output levels of the first reservoir melt burner.

14. A method of controlling a melt furnace, the melt furnace including a first reservoir having a first material level sensor, a first reservoir melt burner, and a first charge full indicator, a second reservoir having a second material level sensor, a second reservoir melt burner, and a second charge full indicator, and a holding reservoir having a molten material level sensor assembly, a temperature sensor, and a holding reservoir burner, the holding reservoir in fluid communication with each of the first reservoir and the second reservoir to receive a first flow of molten material from the first reservoir and a second flow of molten material from the second reservoir, the method comprising:

receiving by a controller one or more signals from one or more of the first material level sensor, the first charge full indicator, the second material level sensor, the second charge full indicator, and the holding reservoir material level sensor assembly;

adjusting with the controller at least one of a first output level of the first reservoir burner and a second output level of the second reservoir burner to one of a plurality of output levels between and including a high output level and a low output level to prevent the build up of material in at least one of a first charge area of the first reservoir based on the first charge full indicator and a second charge area of the second reservoir based on the second charge full indicator; and maintaining with the controller a level of molten material in the holding reservoir by controlling at least one of a first molten material flow from the first reservoir into the holding reservoir and a second molten material flow from the second reservoir into the holding reservoir based, at least in part, on the one or more signals.

15. The method of claim 14, further comprising:

receiving by the controller one or more signals from at least one of the first charge full indicator and the second charge full indicator; and transferring material using the controller to at least one of the first reservoir or the second reservoir when space with the reservoirs becomes available.

16. The method of claim 15, wherein at least one of the first reservoir and the second reservoir is configured to be charged with scrap material from a manufacturing process, the method further comprising preferentially adjusting with the controller the first output level and the second output level to one of the plurality of output levels in response to the one or more signals to control at least one of the first molten material flow and the second molten material flow to maintain the level of molten material in the holding reservoir.

17. The method of claim 16, further comprising adjusting by the controller the output level of the holding reservoir burner to one of the plurality of output levels between and including the high output level and the low output level to maintain the temperature of the molten material contained within.

18. The method of claim 17, further comprising controlling with the controller each of an air supply and a gas supply dependent on the air supply to each of the first reservoir melt burner and the second reservoir melt burner, corresponding to one of the plurality of output levels.

19. The method of claim 18, further comprising correlating by the controller the first flow of molten material and the second flow of molten material into the holding reservoir to at least one of the plurality of output levels of at least one the first reservoir melt burner and the second reservoir melt burner.

* * * * *